US006467227B2

(12) United States Patent
Elmer

(10) Patent No.: US 6,467,227 B2
(45) Date of Patent: Oct. 22, 2002

(54) FASTENING DEVICE WITH MULTIPLE HOLDERS FOR HOLDING A GLASS PANEL, A PLURALITY OF GLASS PANELS, SUCH AS A BUILDING FACADE, HELD TOGETHER BY FASTENING DEVICES WITH MULTIPLE HOLDERS, AND A METHOD OF FASTENING A FACADE ON A STRUCTURE, SUCH AS A BUILDING, WITH A FASTENING DEVICE WITH MULTIPLE HOLDERS

(75) Inventor: Hubert Elmer, Innsbruck (AT)

(73) Assignee: DORMA GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/861,458

(22) Filed: May 18, 2001

(65) Prior Publication Data

US 2002/0012568 A1 Jan. 31, 2002

Related U.S. Application Data

(63) Continuation-in-part of application No. PCT/EP00/09165, filed on Sep. 19, 2000.

(30) Foreign Application Priority Data

Sep. 21, 1999 (DE) ..... 199 45 197

(51) Int. Cl.[7] ..... E04H 1/00
(52) U.S. Cl. ..... 52/235; 403/83; 403/84
(58) Field of Search ..... 52/235, 698; 403/83, 403/84, 160, 170, 180, 303, 305, 377

(56) References Cited

U.S. PATENT DOCUMENTS 3,982,372 A * 9/1976 Haeussler
4,637,175 A * 1/1987 Froening
4,819,748 A * 4/1989 Truscott
5,540,514 A * 7/1996 Demars
6,158,177 A * 12/2000 Blobaum
6,254,397 B1 * 7/2001 Elmer
6,351,915 B1 * 3/2002 Puckett

FOREIGN PATENT DOCUMENTS

| | | |
|---|---|---|
| DE | 19915193 | 11/2000 |
| WO | 9624732 | 8/1996 |

* cited by examiner

*Primary Examiner*—Carl D. Friedman
*Assistant Examiner*—Kevin McDermott
(74) *Attorney, Agent, or Firm*—Nils H. Ljungman & Associates

(57) ABSTRACT

A fastening device for a glass panel on a wall, a building-side substructure, or similar object, such as a building facade, using a clamp fitting that grips the glass panel and a holder that is supported on the clamp fitting that it can move to a limited extent in three dimensions. The invention teaches that the holder has a two-arm connecting bridge that can be fixed in position by means of a center retaining pivot on the clamp fitting whereby, on the outer free ends of the connecting bridge, there are connecting articulations that can be fixed in position for the connection of respective compensating shafts, which are connected on their ends farther away from the connecting bridge by means of respective articulations that can be fixed in position with an adapter for fastening to a wall, a substructure, or similar object.

20 Claims, 7 Drawing Sheets

33
30
20
21
34
31
21
33
32
34
7

FASTENING DEVICE WITH MULTIPLE HOLDERS FOR HOLDING A GLASS PANEL, A PLURALITY OF GLASS PANELS, SUCH AS A BUILDING FACADE, HELD TOGETHER BY FASTENING DEVICES WITH MULTIPLE HOLDERS, AND A METHOD OF FASTENING A FACADE ON A STRUCTURE, SUCH AS A BUILDING, WITH A FASTENING DEVICE WITH MULTIPLE HOLDERS

CONTINUING APPLICATION

This application is a Continuation-In-Part application of International Patent Application No. PCT/EP00/09165, filed on Sep. 19, 2000, which claims priority from Federal Republic of Germany Patent Application No. 199 45 197.4, filed on Sep. 21, 1999. International Patent Application No. PCT/EP00/09165 was pending as of the filing date of this application. The United States was an elected state in International Patent Application No. PCT/EP00/09165.

BACKGROUND OF THE INVENTION

This invention relates to a fastening device for fastening a glass panel to a wall, a building-side substructure, or similar object using a clamp fitting that grips the glass panel and a holder that is supported on the clamp fitting so that it can swivel to a limited extent in three dimensions. An older application by the same applicant (German Laid Open Patent Application No. 199 15 193.8 and corresponding U.S. application Ser. No. 09/498385) that is not yet part of the prior art relates to a clamp fitting, on the inside clamp element of which, a cap bell is supported with an adjustable bias whereby, between the cap bell and the inside clamp element there is a permanently elastic spring element that permits a relative movement of the cap bell with respect to the clamp element. In practical terms, the permanently elastic spring element forms a connection that permits limited articulation, or movement, in three dimensions between the clamp fitting and the holder that is attached to the clamp fitting on the building side. The permanently elastic spring element is thereby intended to compensate for stresses introduced into the glass panel, and can be realized in the form of an elastic pad, for example.

OBJECT OF THE INVENTION

On fastening devices of the type described above, it is desirable to realize the connection between the clamp fitting that grips the glass panel, a wall, a substructure, or an additional glass panel so that tolerances between the components to be connected can be compensated for without generating stresses. This requirement is particularly important for the connection of a glass panel with a wall or substructure. In this case, it can be necessary to connect the clamp fitting or punctiform holder that grips the glass panel by means of a holder with a wall, a substructure, or a similar object, which makes possible a multiple support of this holder on the wall or substructure.

SUMMARY OF THE INVENTION

Beginning with a clamp fitting of the type described above, the invention teaches that the object described above can be accomplished by means of a fastening device for a glass panel on a wall, a building-side substructure, or similar object using a clamp fitting that grips the glass panel and a holder that is supported on the clamp fitting so that it can move to a limited extent in three dimensions, characterized by the fact that the holder has a two-arm connecting bridge that can be fixed in position by means of a center retaining pivot on the clamp fitting whereby, on the outer free ends of the connecting bridge, there are connecting articulations that can be fixed in position for the connection of respective compensating shafts, which are connected on their ends farther away from the connecting bridge by means of respective articulations that can be fixed in position with an adapter for fastening to a wall, a substructure, or similar object.

According to the above technical teaching, the holder has a two-armed connecting bridge that can be fastened to the clamp fitting by means of a center retaining pivot, and connecting joints that can be fixed in position are located on its outer free ends for the connection of respective compensating shafts which, on their ends that are farther from the connecting bridge, are connected by means of respective joints that can be fixed in position with an adapter for fastening to a wall, a substructure, or similar object.

The forces that are introduced into the clamp fitting that supports the glass plate by means of the connecting bridge described above are transmitted to two compensating shafts which, on their free ends, are fastened by means of corresponding adapters to, for example, a wall or any other desired component. Because articulations, joints, or hinges that can be fixed in position are located on the free ends of the two compensating shafts, on the one hand a correct connection of each of the two adapters that takes construction tolerances into consideration is possible, and on the other hand, as a result of the ability to fix the joints in position, it is possible to make the holder virtually completely rigid after installation.

To further explain, the fastening device may comprise a fitting that can attach to glass, two adapters that can attach to a structure or structures, and two holders (compensating shafts) that can connect the fitting to the adapters. Between the fitting and the holders and between the adapters and the holders, there may be respective articulations that can be fixed into position to compensate for construction tolerances and stress in a glass panel mounted on a structure, such as a building facade. The holders have two ends, a first end configured to be attached to a structure and a second end configured to be connected to the fitting. The fitting can also have two ends, a first end configured to be connected to the holders and a second end configured to be attached to a glass panel. The second end of the first holder and the second end of the second holder can be connected by a connecting bridge, which can be attached to the first end of the fitting to permit limited rotation or movement of the holders in at least two dimensions with respect to the fitting. One possible way that the connecting bridge can be attached to the clamp fitting is that the connecting bridge can have a hole into which the first end of the fitting can be inserted. The first end of the fitting can be externally threaded like a screw and the hole of the connecting bridge can be internally threaded. This is only one example of how the fitting can be attached to the connecting bridge. There are also other possible ways of attaching the fitting to the connecting bridge.

In at least one possible embodiment of the present invention, one way. that the retaining pivot or first end of the fitting can be permitted to rotate to a limited extent with respect to the second end of the fitting is that a coupling bell, or cap bell, can connect the first and second ends of the fitting to permit an adjustable bias. An elastic cushion can be placed between the second end of the fitting and the cap bell of the fitting to permit limited movement. The bottom portion of the coupling bell can have a cylindrical extension into which the first end portion of the fitting can fit. The elastic cushion can permit limited movement of the cap bell and the first end portion of the fitting with respect to the second end of the fitting. A nut, or cap nut, can then fit over the bottom of the cap bell. When the nut is tightened or adjusted, the connection between the first end portion of the fitting and the cap bell can be secured or tightened.

Another possible way that the first end portion of the fitting can be permitted to move to a limited extent in three dimensions is that the fitting may comprise a rotational part. The first end of the fitting and the coupling bell of the fitting may comprise corresponding grooves, slots, or indentations, into which the O-ring can fit to secure the connection of the two elements. Before the two elements (the retaining pivot and the coupling bell) are connected, the O-ring can be placed about a groove in the retaining pivot. Because the O-ring is split, it can be compressed into the groove such that the diameter of the compressed O-ring is less than or equal to the diameter of the exterior of the retaining pivot and less than the diameter of the interior of the coupling bell. The retaining pivot can then be inserted into the coupling bell until the compressed O-ring reaches a slot in the coupling bell. The O-ring can then be seated in both the slot and the groove to provide a retaining function to hold the retaining pivot in the coupling bell in a rotatable fashion.

Yet another possible way that the first end of the fitting can be permitted to move to a limited extent in three dimensions is that the fitting can comprise a coupling bell or cap bell which can connect the first end and second end of the fitting. The coupling bell can have a bottom portion facing away from the. second end of the fitting. The bottom portion of the coupling bell, can have a slot and the first end portion of the fitting can fit into the slot with minimal play. The slot can permit movement of the first end portion of the fitting, and the holders when the holders are attached to the connecting bridge, in three dimensions. A retaining flange surrounding the first end portion of the fitting can permit minimal movement of the first end portion of the fitting within a support flange of the coupling bell. A nut or cap nut can then fit over the coupling bell of the fitting. When the nut is tightened, turned, or rotated, the play in the slot of the cap bell can permit the first end portion of the fitting to move into different positions in the slot. In other words, rotating the nut, or tightening it with a wrench, can displace the slot with respect to the first end portion of the fitting, thereby permitting a limited rotational movement of the first end portion of the fitting, and the holders when they are attached to the fitting, in three dimensions. The first end portion of the fitting may also be turned or rotated to tighten the connection between the connecting bridge and the fitting.

One possible way that the clamp fitting may be attached to a glass panel is with a bolt or screw. The glass panel can have a hole through which a bolt can be inserted. An opposite end of the bolt can be inserted into the second end of the fitting, thereby connecting the fitting to a glass panel. A spacer with a hole for the reception of a bolt can also be placed between the fitting and the glass panel to protect the glass from being damaged by the fitting. If the glass panel comprises two glass panes, a spacer may also be placed between the two panes to protect the glass from being damaged by the bolt.

One possible way that the adapters may be attached to a structure is with fastening screws or bolts. The adapters have two end portions, a first end that is configured to be attached to a structure and a second end that is configured to be attached to a first end of a holder. Screws or bolts can be inserted into holes in the first ends of the adapters and then through corresponding holes in a structure or structures to connect the adapters to a structure, such as a facade on a building.

Additional characteristics of the invention are described herein.

It has proven advantageous to place pivot forks on the outer free ends of the arms of the connection bridge, while pivot brackets are located on the opposite free ends of the compensating shafts whereby, these pivot brackets are preferably offset from each other by 90°. To further explain, the connecting bridge can be configured to dispose the second end portion of the first compensating shaft or holder and the second end portion of the second compensating shaft or holder at an angle of ninety degrees from one another. It goes without saying that, for example, in a kinematic reversal, the pivot forks can be provided on the compensating shafts and corresponding pivot brackets on the connecting bridge or on the adapter.

To further explain, one part of an articulation comprises a fork and a second part of an articulation comprises a bracket or tongue. The tongue portion of an articulation is configured to be disposed in the fork portion of the articulation to permit back and forth swinging movement or pivotal movement of the holders with respect to the corresponding adapter and/or fitting.

A first articulation can comprise the second end of the first adapter and the first end portion of the first compensating shaft, a second articulation can comprise the second end portion of the second adapter and the first end portion of the second compensating shaft, a third articulation can comprise the first arm of the connecting bridge and the second end portion of the first holder or compensating shaft, a fourth articulation can comprise the second arm of the connecting bridge and the second end portion of the second compensating shaft or holder.

In at least one possible embodiment of the present invention, a first articulation can comprise the second end of the first adapter comprising a fork and the first end of the first holder comprising a tongue, a second articulation can comprise the second end of the second adapter comprising a fork and the first end of the second holder comprising a tongue, a third articulation can comprise the first arm of the connecting bridge comprising a fork and the second end of the first compensating shaft or holder comprising a tongue, and a fourth articulation can comprise the second arm of the connecting bridge comprising a fork and the second end of the second compensating shaft or holder comprising a tongue.

In another possible embodiment of the present invention, a first articulation can comprise the second end of the first adapter comprising a fork and the first end of the first holder comprising a tongue, a second articulation can comprise the second end of the second adapter comprising a tongue and the first end of the second holder comprising a fork, a third articulation can comprise the first arm of the connecting bridge comprising a fork and the second end of the first compensating shaft or holder comprising a tongue and a fourth articulation can comprise the second arm of the connecting bridge comprising a fork and the second end of the second compensating shaft or holder comprising a tongue.

In yet another possible embodiment of the present invention, a first articulation can comprise the second end of the first adapter comprising a fork and the first end of the first holder comprising a tongue, a second articulation can comprise the second end of the second adapter comprising a fork and the first end of the second holder comprising a tongue, a third articulation can comprise the first arm of the connecting bridge comprising a fork and the second end of the first compensating shaft or holder comprising a tongue and a fourth articulation can comprise the second arm of the connecting bridge comprising a tongue and the second end of the second compensating shaft or holder comprising a fork.

In still another possible embodiment of the present invention, a first articulation can comprise the second end of the first adapter comprising a fork and the first end of the first holder comprising a tongue, a second articulation can comprise the second end of the second adapter comprising a tongue and the first end of the second holder comprising a fork, a third articulation can comprise the first arm of the connecting bridge comprising a fork and the second end of the first compensating shaft or holder comprising a tongue and a fourth articulation can comprise the second arm of the connecting bridge comprising a tongue and the second end of the second compensating shaft or holder comprising a fork.

In a further possible embodiment of the present invention, a first articulation can comprise the second end of the first adapter comprising a tongue and the first end of the first holder comprising a fork, a second articulation can comprise the second end of the second adapter comprising a fork and the first end of the second holder comprising a tongue, a third articulation can comprise the first arm of the connecting bridge comprising a fork and the second end of the first compensating shaft or holder comprising a tongue and a fourth articulation can comprise the second arm of the connecting bridge comprising a fork and the second end of the second compensating shaft or holder comprising a tongue.

In another possible embodiment of the present invention, a first articulation can comprise the second end of the first adapter comprising a tongue and the first end of the first holder comprising a fork, a second articulation can comprise the second end of the second adapter comprising a tongue and the first end of the second holder comprising a fork, a third articulation can comprise the first arm of the connecting bridge comprising a fork and the second end of the first compensating shaft or holder comprising a tongue and a fourth articulation can comprise the second arm of the connecting bridge comprising a fork and the second end of the second compensating shaft or holder comprising a tongue.

In yet another possible embodiment of the present invention, a first articulation can comprise the second end of the first adapter comprising a tongue and the first end of the first holder comprising a fork, a second articulation can comprise the second end of the second adapter comprising a fork and the first end of the second holder comprising a tongue, a third articulation can comprise the first arm of the connecting bridge comprising a fork and the second end of the first compensating shaft or holder comprising a tongue and a fourth articulation can comprise the second arm of the connecting bridge comprising a tongue and the second end of the second compensating shaft or holder comprising a fork.

In still another possible embodiment of the present invention, a first articulation can comprise the second end of the first adapter comprising a tongue and the first end of the first holder comprising a fork, a second articulation can comprise the second end of the second adapter comprising a tongue and the first end of the second holder comprising a tongue, a third articulation can comprise the first arm of the connecting bridge comprising a fork and the second end of the first compensating shaft or holder comprising a tongue and a fourth articulation can comprise the second arm of the connecting bridge comprising a tongue and the second end of the second compensating shaft or holder comprising a fork.

In a further possible embodiment of the present invention, a first articulation can comprise the second end of the first adapter comprising a fork and the first end of the first holder comprising a tongue, a second articulation can comprise the second end of the second adapter comprising a fork and the first end of the second holder comprising a tongue, a third articulation can comprise the first arm of the connecting bridge comprising a tongue and the second end of the first compensating shaft or holder comprising a fork and a fourth articulation can comprise the second arm of the connecting bridge comprising a fork and the second end of the second compensating shaft or holder comprising a tongue.

In another possible embodiment of the present invention, a first articulation can comprise the second end of the first adapter comprising a fork and the first end of the first holder comprising a tongue, a second articulation can comprise the second end of the second adapter comprising a tongue and the first end of the second holder comprising a fork, a third articulation can comprise the first arm of the connecting bridge comprising a tongue and the second end of the first compensating shaft or holder comprising a fork and a fourth articulation can comprise the second arm of the connecting bridge comprising a fork and the second end of the second compensating shaft or holder comprising a tongue.

In yet another possible embodiment of the present invention, a first articulation can comprise the second end of the first adapter comprising a fork and the first end of the first holder comprising a tongue, a second articulation can comprise the second end of the second adapter comprising a fork and the first end of the second holder comprising a tongue, a third articulation can comprise the first arm of the connecting bridge comprising a tongue and the second end of the first compensating shaft or holder comprising a fork and a fourth articulation can comprise the second arm of the connecting bridge comprising a tongue and the second end of the second compensating shaft or holder comprising a fork.

In still another possible embodiment of the present invention, a first articulation can comprise the second end of the first adapter comprising a fork and the first end of the first holder comprising a tongue, a second articulation can comprise the second end of the second adapter comprising a tongue and the first end of the second holder comprising a fork, a third articulation can comprise the first arm of the connecting bridge comprising a tongue and the second end of the first compensating shaft or holder comprising a fork and a fourth articulation can comprise the second arm of the connecting bridge comprising a tongue and the second end of the second compensating shaft or holder comprising a fork.

In a further possible embodiment of the present invention, a first articulation can comprise the second end of the first adapter comprising a tongue and the first end of the first holder comprising a fork, and a second articulation can comprise the second end of the second adapter comprising a fork and the first end of the second holder comprising a tongue, a third articulation can comprise the first arm of the connecting bridge comprising a tongue and the second end of the first compensating shaft or holder comprising a fork and a fourth articulation can comprise the second arm of the connecting bridge comprising a fork and the second end of the second compensating shaft or holder comprising a tongue.

In another possible embodiment of the present invention, a first articulation can comprise the second end of the first adapter comprising a tongue and the first end of the first holder comprising a fork, a second articulation can comprise the second end of the second adapter comprising a tongue and the first end of the second holder comprising a fork, a third articulation can comprise the first arm of the connecting bridge comprising a tongue and the second end of the first compensating shaft or holder comprising a fork and a fourth articulation can comprise the second arm of the connecting bridge comprising a fork and the second end of the second compensating shaft or holder comprising a tongue.

In yet another possible embodiment of the present invention, a first articulation can comprise the second end of the first adapter comprising a tongue and the first end of the first holder comprising a fork, a second articulation can comprise the second end of the second adapter comprising a fork and the first end of the second holder comprising a tongue , a third articulation can comprise the first arm of the connecting bridge comprising a tongue and the second end of the first compensating shaft or holder comprising a fork and a fourth articulation can comprise the second arm of the connecting bridge comprising a tongue and the second end of the second compensating shaft or holder comprising a fork.

In a further possible embodiment of the present invention, a first articulation can comprise the second end of the first adapter comprising a tongue and the first end of the first holder comprising a fork, a second articulation can comprise the second end of the second adapter comprising a tongue and the first end of the second holder comprising a fork, a third articulation can comprise the first arm of the connecting bridge comprising a tongue and the second end of the first compensating shaft or holder comprising a fork and a fourth articulation can comprise the second arm of the connecting bridge comprising a tongue and the second end of the second compensating shaft or holder comprising a fork.

To fix the above-mentioned articulations in position, the pivot forks of the connection bridge and the pivot brackets of the compensating shafts, as well as the pivot forks of the adapters, have aligned borings to receive clamp screws.

In other words, the forks and tongues (brackets) of the pivots, or articulations, can have holes into which screws can be inserted. Tightening the screws can fix the respective articulations into position.

With the configuration of the holder described above, it is obviously possible, for example, to connect one of the adapters to a wall that runs vertically and the second adapter to a ceiling that runs orthogonally to the above-mentioned wall. The realization of the articulations described above makes such an installation possible.

To further explain, in at least one possible embodiment of the present invention, one of the adapters may be connected to one structure while the other adapter may be connected to another structure perpendicular to or at a right angle with the first structure.

In a further configuration, the arms of the connecting bridge and the retaining pivot that can be fixed in position on the clamp fitting are realized in one piece. In other words, these components form a T-shaped piece that is, in itself, rigid or essentially rigid. To further explain, the connecting bridge and the first end of the fitting can comprise a single connecting element that is configured to connect the first holder and the second holder and configured to attach the fitting to the holders.

The retaining pivot of the connecting bridge in the clamping figure is fixed in position by means of a cap nut that covers a cap bell of the clamp fixture. The cap nut, the retaining pivot and the compensating shafts have flats on their shell surfaces for the application of a wrench, by means of which, the individual components can be rotated into their required positions during installation to adjust them to the construction tolerances before the articulations are fixed in position and the retaining pivot is fixed in position between the cap bell and the cap nut. In an additional configuration of the invention, the pivot brackets are mounted so that they can rotate in the compensating shafts.

In other words, the nut, the first end portion of the fitting, and the compensating shafts or holders have flattened portions on their surfaces. The flattened portions can be configured to receive a wrench. Both the nut and the holders can then be turned with a wrench to adjust or tighten the connections between the various elements of the fastening device. The nut can be tightened with a wrench to tighten the connection between the first end portion of the fitting and the coupling bell. The first end portion of the fitting can be rotated to adjust or to tighten the connection between the connecting bridge and the fitting. At least one of the holders can be rotated or adjusted to tighten the connection between at least one end of at least one holder and the corresponding adapter or fitting.

In addition to the two-dimensional pivotal movements of the articulations and the possible rotational movement of the first end portion of the fitting, the fastening device can also comprise at least one other rotational part located in at least one end of at least one of the compensating shafts or holders. The rotational part can comprise a split O-ring as described above. The two elements to be connected by the rotational part (for instance, the shaft portion of a holder and an end of a holder) can comprise slots, grooves, or indentations into which the O-ring can fit tightly with very little play to provide a retaining function to hold the end of a holder in the shaft portion of the holder, or vice versa, in a rotatable fashion. In other words, a rotational part can permit at least one of the first end portion of the first holder, the second end portion of the first holder, the first end portion of the second holder, and the second end portion of the second holder to be rotated.

In at least one possible embodiment of the present invention, a rotational part can be located in the first end portion of the first compensating shaft or holder, the second end portion of the first compensating shaft or holder, the first end portion of the second compensating shaft or holder, and the second end portion of the second compensating shaft or holder, thereby permitting all four parts to rotate.

In another possible embodiment of the present invention, a rotational part can be located in the first end portion of the first compensating shaft or holder thereby permitting that part to rotate.

In yet another possible embodiment of the present invention, a rotational part can be located in the second end portion of the first compensating shaft or holder, thereby permitting that part to rotate.

In still another possible embodiment of the present invention, a rotational part can be located in the first end portion of the second compensating shaft or holder, thereby permitting that part to rotate.

In a further possible embodiment of the present invention, a rotational part can be located in the second end portion of the second compensating shaft or holder, thereby permitting that part to rotate.

In another possible embodiment of the present invention, a rotational part can be located in the first end portion of the first compensating shaft or holder and the second end portion of the first compensating shaft or holder thereby permitting both parts to rotate.

In yet another possible embodiment of the present invention, a rotational part can be located in the first end portion of the first compensating shaft or holder and the first end portion of the second compensating shaft or holder, thereby permitting both parts to rotate.

In still another possible embodiment of the present invention, a rotational part can be located in the first end portion of the first compensating shaft or holder and the second end portion of the second compensating shaft or holder, thereby permitting both parts to rotate.

In a further possible embodiment of the present invention, a rotational part can be located in the second end portion of the first compensating shaft or holder and the first end portion of the second compensating shaft or holder, thereby permitting both parts to rotate.

In another possible embodiment of the present invention, a rotational part can be located in the second end portion of the first compensating shaft or holder and the second end portion of the second compensating shaft or holder, thereby permitting both parts to rotate.

In yet another possible embodiment of the present invention, a rotational part can be located in the first end portion of the second compensating shaft or holder, and the second end portion of the second compensating shaft or holder, thereby permitting both parts to rotate.

Consequently, the invention teaches that the holder for a fastening for a glass panel, has two support points or connecting points, whereby the components of the holder are adjustable and can be fixed in position after the adjustment, so that they can not only be adapted to compensate for extraordinarily large construction tolerances, but also can be connected to a substructure, for example, to components that are at an angle to each other. For instance, the fastening device can connect a plurality of glass panels, such as in a building facade.

The above-discussed embodiments of the present invention will be described further herein below. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and nonobvious one with respect to the other.

BRIEF DESCRIPTION OF THE DRAWINGS

The invention is explained in greater detail below with reference to the exemplary embodiment illustrated in the accompanying figures, in which.

DESCRIPTION OF THE PREFERRED EMBODIMENT

Figure 1:
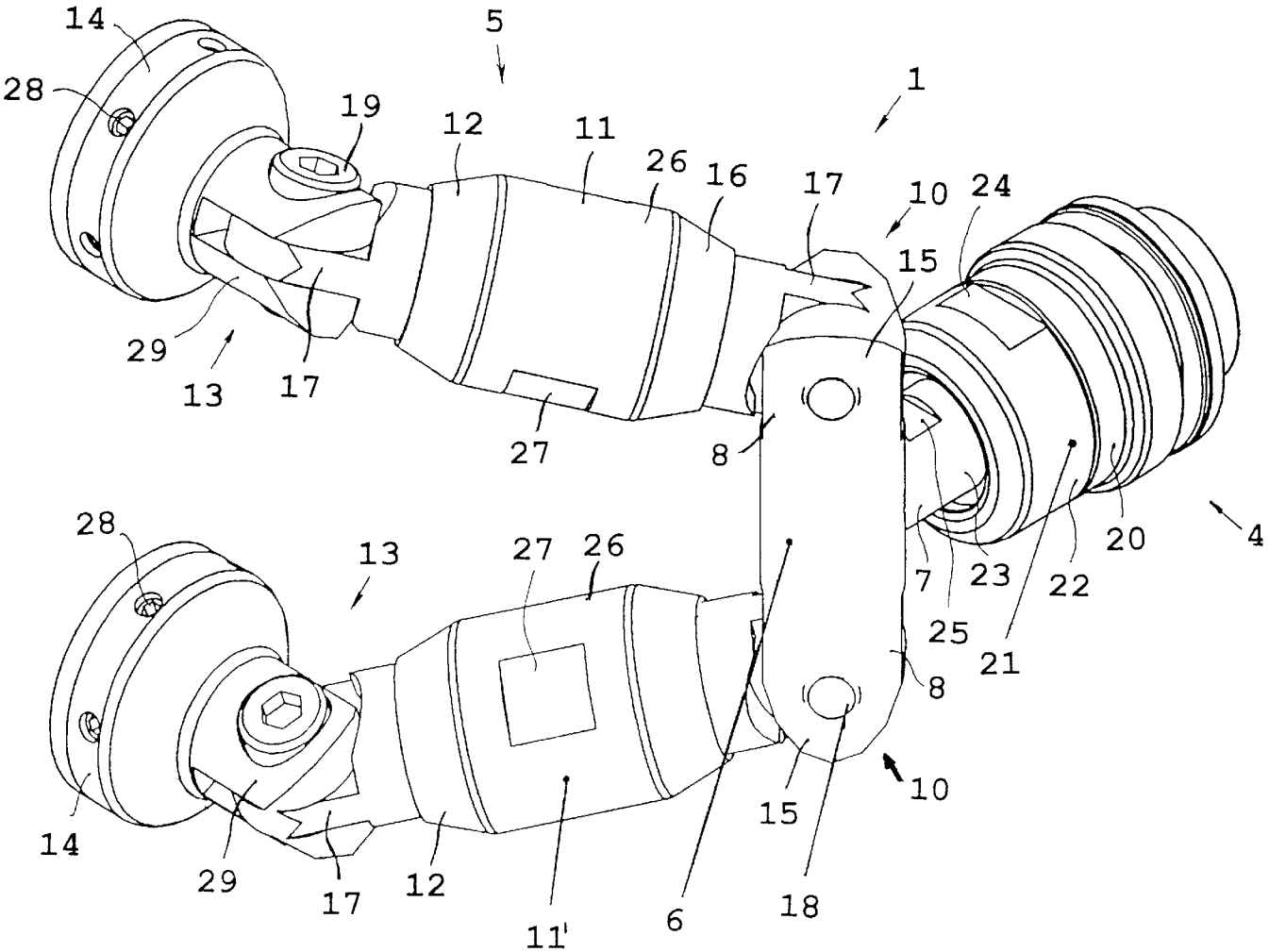
FIG. 1: is a view in perspective of the fastening device.

The invention relates to a fastening device for a glass panel (2) on a wall (3), a building-side substructure, or similar object using a clamp fitting (4) that gripes the glass panel (2) and a holder (5) that is supported on the clamp fitting (4) so that it can move to a limited extent in three dimensions. The invention teaches that the holder (5) has a two-arm (arms 8) connecting bridge (6) that can be fixed in position by means of a center retaining pivot (7) on the clamp fitting (4) whereby, on the outer free ends (9) of the connecting bridge (6), there are connecting articulations (10) that can be fixed in position for the connection of respective compensating shafts (11, 11'), which are connected on their ends (12) farther away from the connecting bridge (6) by means of respective articulations (13) that can be fixed in position with an adapter (14) for fastening to a wall (3), a substructure, or similar object.

Figure 2:
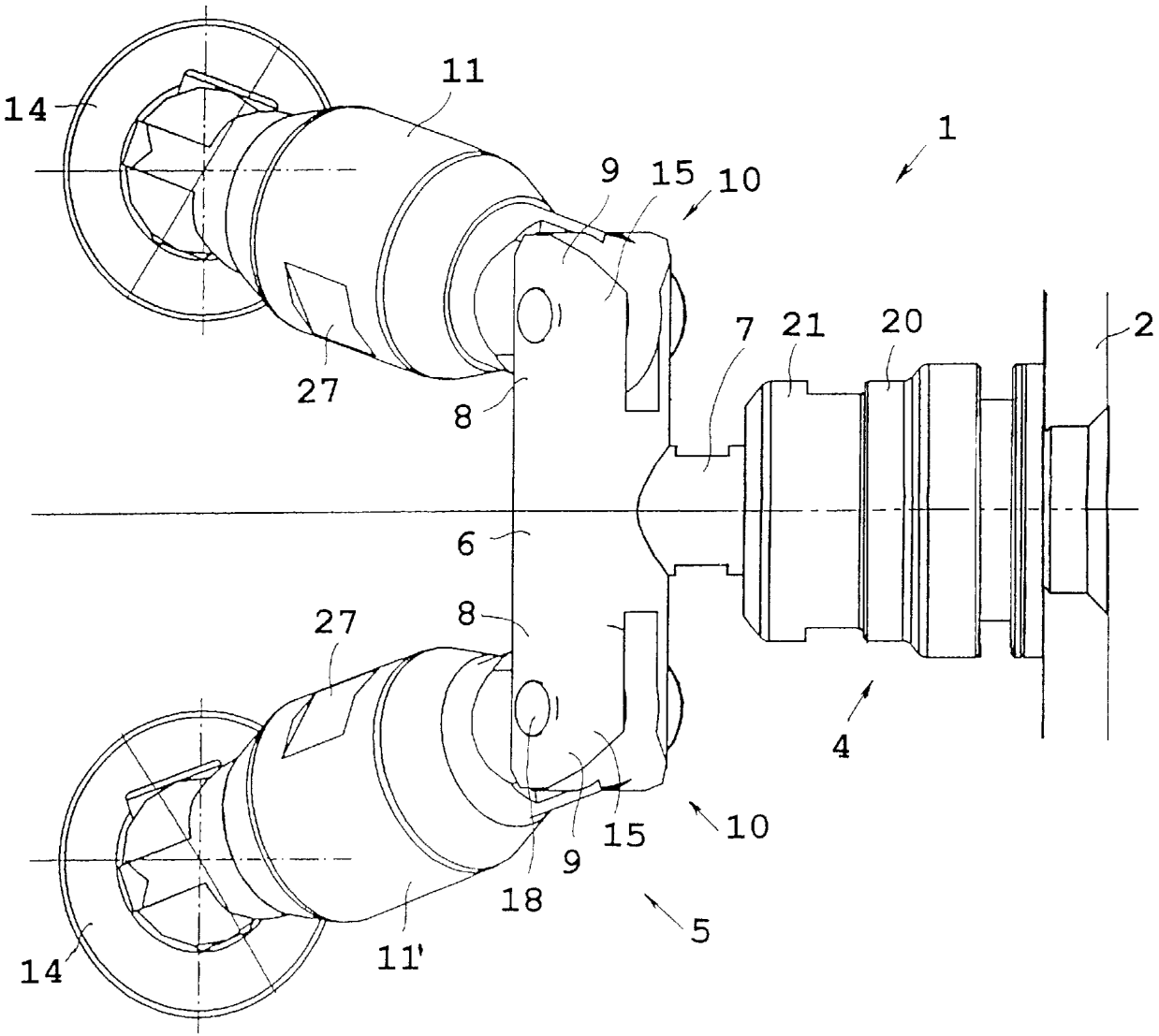
FIG. 2: is a side view.
Figure 3:
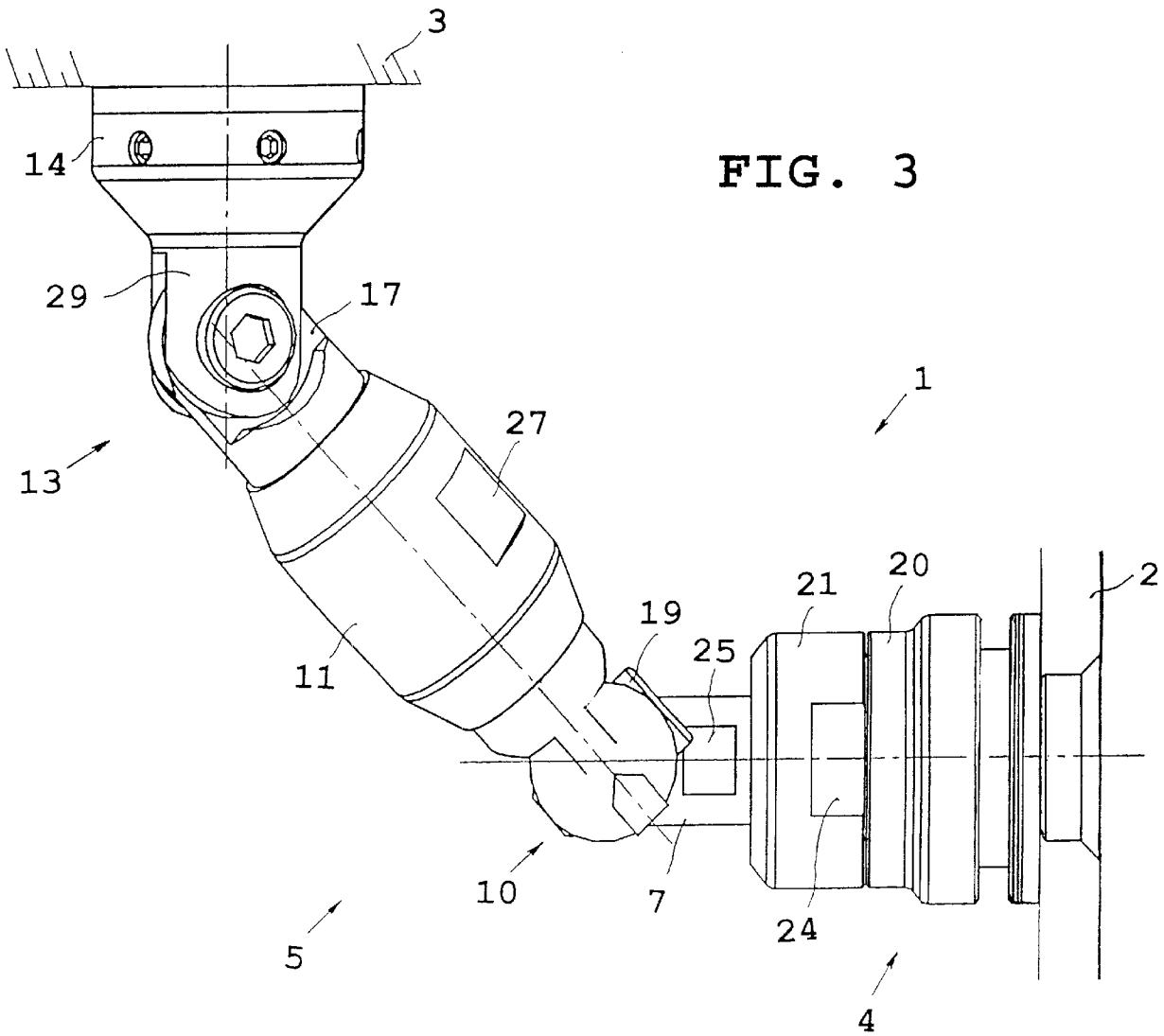
FIG. 3: is an overhead view of the embodiment illustrated in FIG. 2.

A fastening device designated 1 in general has a clamp fitting 4 that is designed to grip a glass panel 2 (FIGS. 2 and 3). The clamp fitting 4 can basically be constructed in any desired manner, but it should have a connection that is articulated to a limited extent in three dimensions to the holder that is designated 5 in general. The holder 5 is engaged by means of a retaining pivot 7 in the clamp fitting 4, whereby the retaining pivot 7 is fixed in position between a cap bell 20 and a cap nut 21 on the clamp fitting 4. A connecting bridge 6 is formed in one piece with the retaining pivot 7. On the free ends 9 of the arms 8 of the connecting bridge 6 there are connecting articulations 10 that can be fixed in position and which are realized in the form of pivot forks 15. Engaged in these pivot forks 15 are pivot brackets 17 of two compensating shafts 11, 11'. On the ends 12 of the compensating shafts 11 or 11' farther away from the connecting bridge 6 there are also articulations 13 that can be fixed in position, and each of which consists of a pivot fork 29 that forms a component of an adapter and the pivot brackets 17 of the compensating shafts 11 and 11'. The pivot brackets 17 located on the free ends 12, 16 of the compensating shafts 11, 11' can be replaced in a kinematic reversal of the pivot hinges and pivot forks. The connecting articulations 10 and 13 are fixed in position by clamp screws 19 that run through aligned borings 18.

As mentioned above, each of the four articulations comprises one forked portion and one tongue portion, which fit together to permit pivotal motion. The forks and tongues (brackets) can be positioned on either part of an articulation as described above. The screws 19 that can be inserted into the holes 18 in the forks and tongues of the articulations 10 and 13 can be tightened to secure or fix the articulations into place.

As the figures also show, the cap nut 21 has flats 24 on its shell surface 22, while there are flats 25 on a shell surface 23 of the retaining pivot 7, and flats 27 on a shell surface 26 of the compensating shafts 11, 11'. The flats 24, 25, 27 are used to adjust the holder 5 with a wrench during the installation or assembly of the retaining pivot 7 between the cap bell 20 and the cap nut 21.

As mentioned, the flats 24, 25, and 27 on the surfaces of the cap nut 21, first end portion of the fitting (retaining pivot) 7, and the first and second holders (compensating shafts) 11, 11' can permit additional rotational adjustment of the parts of the fastening device. The flattened portions 24, 25, 27 can also permit the connections between the parts of the fastening device to be tightened.

The adapters 14 that can be fastened to a wall 3 or similar object, for example, another glass panel in a building facade, consist of two components that can be rotated with respect to one another, and the position of which in relation to each other can be set by means of Allen screws 28.

In other words, in addition to the possible rotational movements of the first end portion of the fitting (retaining pivot) 7 and the ends of the holders (compensating shafts) 11 and 11', at least one of the adapters 14 can also comprise a rotational part possibly comprising a split O-ring as described above. The O-ring can permit the first and second ends of an adapter to be rotated with respect to one another. The two elements to be connected by the rotational part can comprise slots, grooves, or indentations into which the O-ring can fit tightly with very little play to provide a retaining function to hold the second end of the adapter in the first end of the adapter, or vice versa, in a rotatable fashion. The rotational part can permit the forked or bracketed second end portion of an adapter 14 and the first end portion of an adapter 14 configured to be attached to a structure to rotate with respect to one another. The position of the two parts in relation to one another can be fixed or set by screws, such as Allen screws 28.

Figure 4:
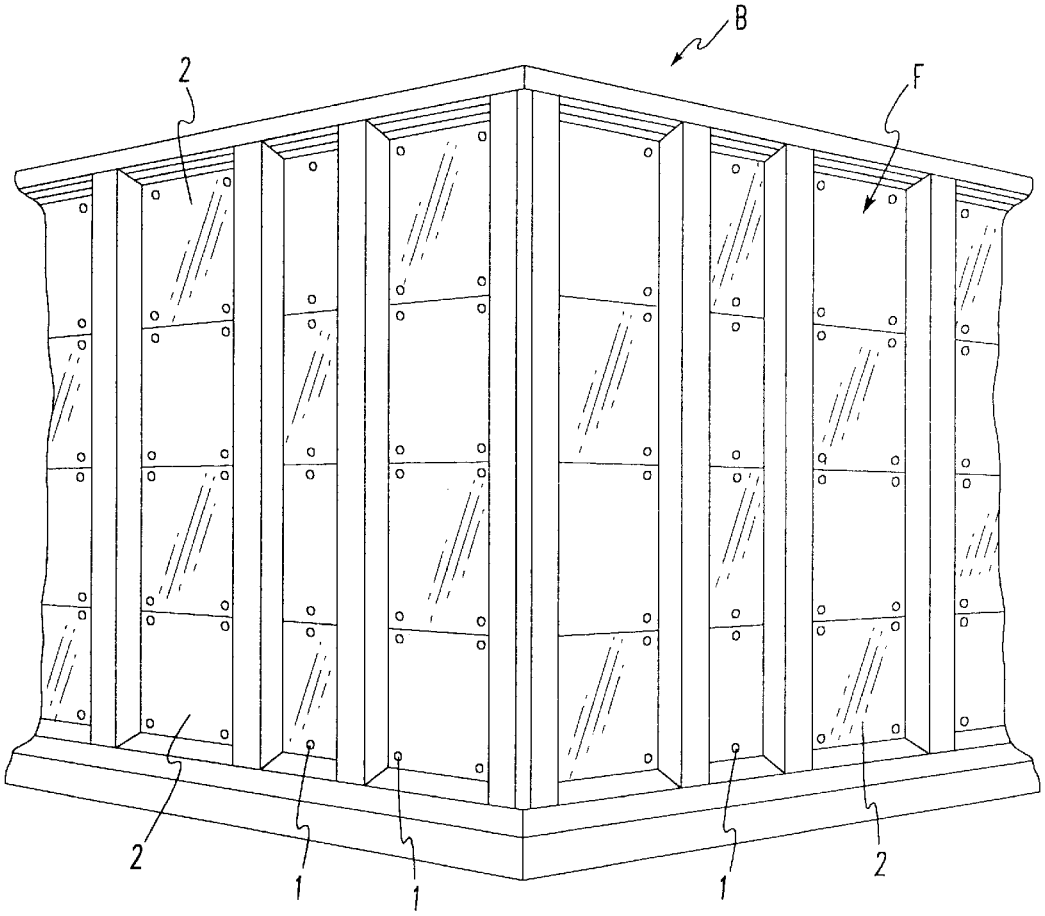
FIG. 4: is a perspective view of a building with a facade.

FIG. 4 shows a building B with a facade F comprising a plurality of glass panels 2. FIG. 4 also shows the attachment of fastening devices 1.

Figure 5:
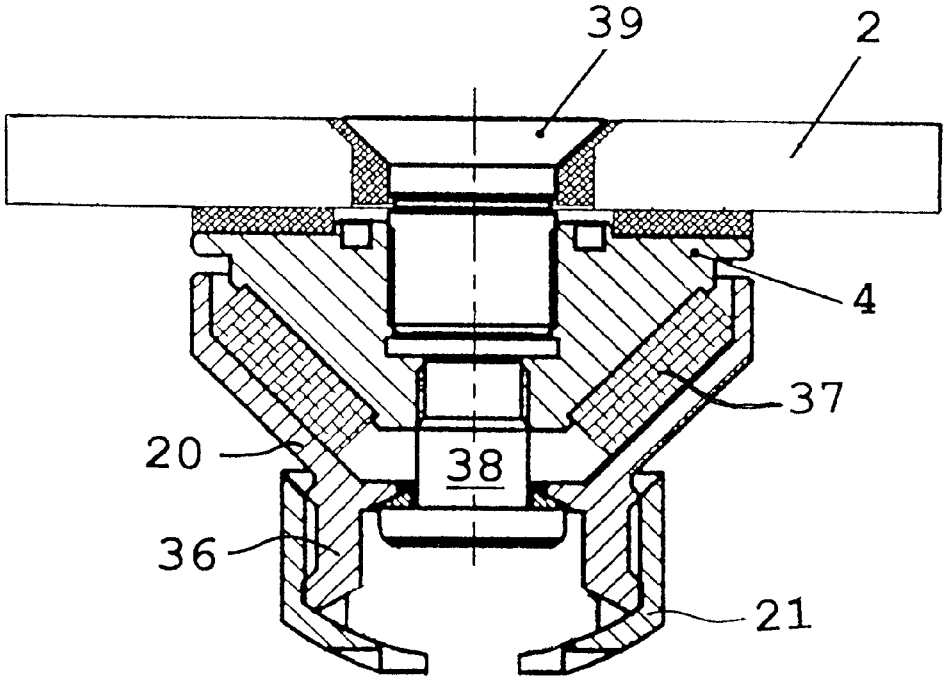
FIG. 5: illustrates a sectional view of a possible configuration of the clamp fitting and cap bell.

FIG. 5 shows a possible configuration of the cap bell 20. It also illustrates a possible connection of the second end of the fitting 4 to a glass panel 2. The second end of the fitting 4 can be connected to a glass panel 2 with a bolt 39 that can be inserted into corresponding holes in the glass 2 and the second end of the fitting 4. The cap bell 20 can connect the first end and the second end of the fitting 4. The second end of the clamp fitting 4 can be connected to the cap bell 20 by a screw or bolt 38 which fits into corresponding holes in the cap bell 20 and the second end of the clamp fitting 4. An elastic cushion 37 can be disposed between an outer surface of the second end of the fitting 4, and an inner surface of the cap bell 20, to permit adjustable bias or limited movement. The bottom portion of the cap bell 20 can have a cylindrical extension 36 into which the first end of the fitting or retaining pivot (not shown) can fit. As shown, the cap nut 21 can fit over the bottom portion of the cap bell 20. The nut 21 can be adjusted to tighten the connection between the first end of the fitting (retaining pivot) 7 (not shown) and the cap bell 20.

Figure 6:
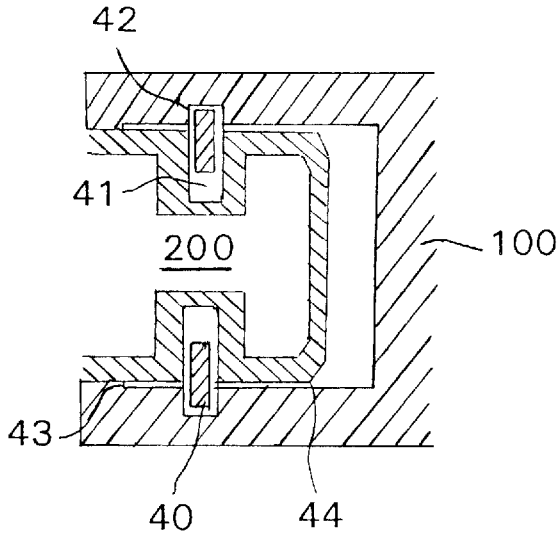
FIG. 6: is a sectional view showing a possible configuration of a rotational part.

FIG. 6 shows a possible configuration of a rotational part. The rotational part can be located between the first and second ends of the adapters 14 and/or in one or more of the ends of the compensating shafts 11 and 11'. It is also possible for such a rotational part to form the connection between the inner bottom of the cap bell 20 and the first end of the fitting (retaining pivot) 7. One element 100 of the rotational part can comprise a slot 42 into which a split O-ring 40 can fit. A second element 200 of the connection can comprise an end with a groove 41 into which a split O-ring 40 can fit. The element 200 can be inserted into the element 100 to form the rotational connection. Before the two elements 100, 200 are connected, the O-ring 40 can be placed about the second element 200 in the groove 41. Since the O-ring 40 is split, it can be compressed into the groove 41 such that the diameter of the compressed O-ring 40 is less than or equal to the diameter 44 of the exterior of the second element 200 and less than the diameter 43 of the interior of the first element 100. The second element 200 can then be inserted into the first element 100 until the compressed O-ring 40 reaches the slot 42. The O-ring 40 can then be seated in both the slot 42 and the groove 41 to provide a retaining function to hold the second element 200 in the first element 100 in a rotatable fashion. The O-ring 40 can fit very tightly into the slot 42 and the groove 41 to avoid any rattling or play. The elements 100, 200 of the rotational part can be hollow, as shown, or solid. The elements 100, 200 of the rotational part can comprise the two parts of an adapter 14, the retaining pivot 7 and the cap bell 20 of the clamp fitting 4, or an end 12, 16 and shaft portion of a holder 11, 11'. FIG. 6 is only one example of a possible rotational connection. There are other ways of connecting the shaft pieces, the adapter pieces, and the clamp fitting pieces together to permit rotation with very little play.

Figure 7:
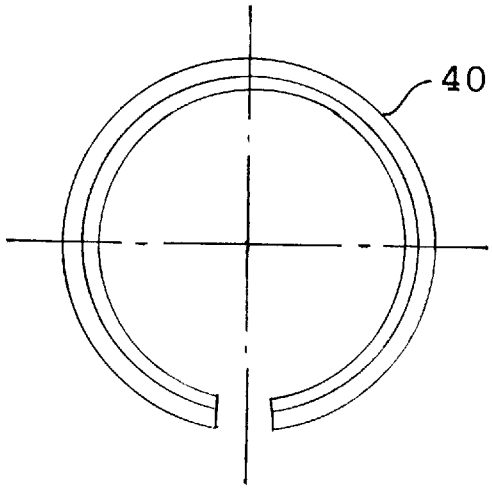
FIG. 7: is a top plan view of a split O-ring.

FIG. 7 shows a possible configuration of a split O-ring, 40 which can comprise an additional rotational part in one or both of the adapters 14 or one or more of the ends of the compensating shafts 11 and 11' or in the clamp fitting.

Figures 8, 9, 10:
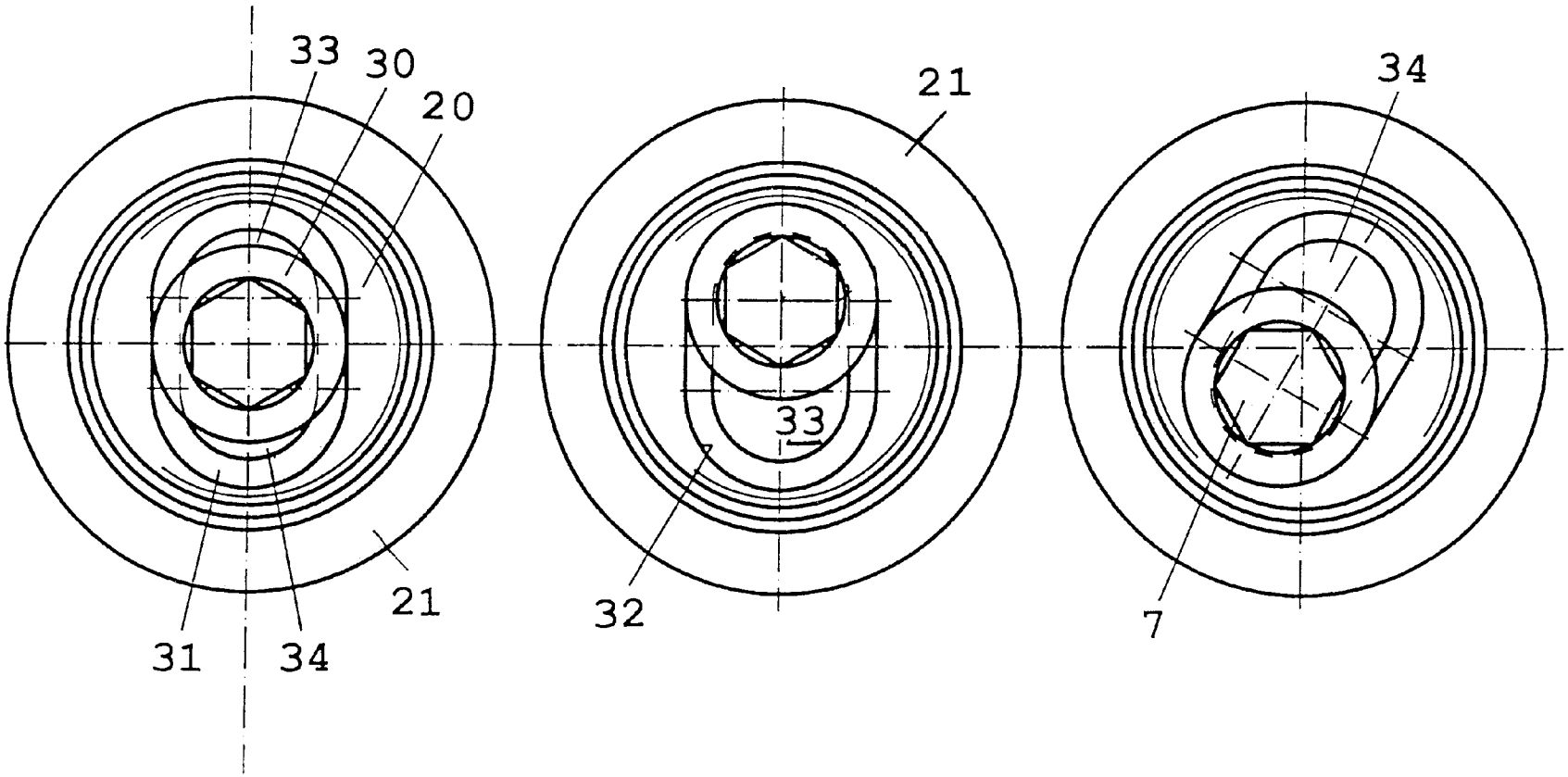
FIG. 8: is a sectional view of another possible configuration of the bottom portion of the cap bell.
FIG. 9: shows a view of the embodiment in FIG. 8 in a different position.
FIG. 10: shows a view of the embodiment in FIG. 8 in a different position.

FIGS. 8, 9, and 10 show another possible configuration of the inside bottom area of the coupling bell (cap bell) 20, illustrating one possible way that the first end of the fitting (retaining pivot) 7 can move to a limited extent in three dimensions. The bottom of the cap bell 20 can have a retaining flange 30, which holds the first end of the fitting (retaining pivot) 7, and a support flange 31 that can fit into a slot-like groove 32 to support the first end of the fitting (retaining pivot) 7. As FIG. 9 shows, the cap bell 20 can have a slot 33, into which the first end of the fitting (retaining pivot) 7 can fit with minimal play 34. As shown in FIGS. 9 and 10, when the nut or cap nut 21 is turned, the first end of the fitting (retaining pivot) 7 can be displaced in the slot 33 of the cap bell 20.

One feature of the invention resides broadly in a fastening device for a glass panel 2 on a wall 3, a building-side substructure, or similar object using a clamp fitting 4 that grips the glass panel 2 and a holder 5 that is supported on the clamp fitting 4 so that it can move to a limited extent in three dimensions, characterized by the fact that the holder 5 has a two-arm (arms 8) connecting bridge 6 that can be fixed in position by means of a center retaining pivot 7 on the clamp fitting 4, whereby on the outer free ends 9 of the connecting bridge 6 there are connecting articulations 10 that can be fixed in position for the connection of respective compensating shafts 11, 11', which are connected on their ends 12 farther away from the connecting bridge 6 by means of respective articulations 13 that can be fixed in position with an adapter 14 for fastening to a wall 3, a substructure or similar object.

Another feature of the invention resides broadly in a fastening device characterized by the fact that pivot forks 15 are realized on the outer free ends 9 of the arms 8 of the connecting bridge 6.

Yet another feature of the invention resides broadly in a fastening device characterized by the fact that pivot brackets 17 are located on the opposite free ends 12, 16 of the compensating shafts 11, 11'.

Still another feature of the invention resides broadly in a fastening device characterized by the fact that the pivot brackets 17 are offset from each other by 90°.

A further feature of the invention resides broadly in a fastening device characterized by the fact that the pivot forks 15 of the connecting bridge 6 and the pivot brackets 17 of the compensating shafts 11, 11' have aligned borings 18 to receive clamping screws 19.

Another feature of the invention resides broadly in a fastening device characterized by the fact that the arms 8 of the connecting bridge 6 and the retaining pivot 7 that can be fixed on the clamp fixture 4 are realized in one piece.

Yet another feature of the invention resides broadly in a fastening device characterized by the fact that the retaining pivot 7 of the connecting bridge 6 can be fixed in position by means of a cap nut 21 that covers a cap bell 20 of the clamp fixture 4.

Still another feature of the invention resides broadly in a fastening device characterized by the fact that the cap nut 21 and the retaining pivot 7 have flats 24, 25 on their shell surfaces 22, 23.

A further feature of the invention resides broadly in a fastening device characterized by the fact that the compensating shafts 11, 11' have flats 27 on their shell surfaces 26.

Another feature of the invention resides broadly in a fastening device characterized by the fact that the pivot brackets 17 are mounted so that they can rotate in the compensating shafts 11, 11'.

Yet another feature of the invention resides broadly in a fastening device characterized by the fact that the articulation connections of the adapters 14 are realized in the form of pivot forks 29.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 199 45 197.4, filed on Sep. 21, 1999, having inventor Hubert ELMER, and entitled "Befestigungsvorrichtung fur eine glasscheibe" and DE-OS 199 45 197.4 and DE-PS 199 45 197.4, and International Application No. PCT/EP00/09165, filed on Sep. 19, 2000, having inventor Hubert ELMER, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The following U.S. patents and patent applications are hereby incorporated by reference as if set forth in their entirety herein: U.S. Pat. No. 6,131,346, having attorney docket No. NHL-DOR-54 US, having inventor Herbert KORDES, issued on Oct. 17, 2000 and entitled, "Clamping fitting to attach glass panes"; U.S. Pat. No. 6,158,177, having attorney docket No. NHL-DOR-48 US, having inventor Ernst Udo BLÖBAUM, issued on Dec. 12, 2000 and entitled, "Clamping mounting for glass plates, and a kit to construct a clamping mounting to mount glass plates, and a method to utilize a kit to construct a clamping mounting to mount glass plates"; U.S. patent application Ser. No. 09/731,265, having attorney docket No. NHL-DOR-83 US, having inventors Ernst Udo BLÖBAUM and Reinhard JANUTTA, filed on Dec. 6, 2000 and entitled, "Building glass facade of a building, a clamping arrangement for holding glass panels in a glass facade of a building, a brace to hold safety glass panels in a glass facade of a building, and a brace to hold safety glass panels"; U.S. patent application Ser. No. 09/498,385, having attorney docket No. NHL-DOR-68 US, having inventor Hubert ELMER, filed on Feb. 3, 2000 and entitled, "Attachment device for a glass pane at a mounting fixed to a structure"; U.S. patent application Ser. No. 09/854,411, having attorney docket No. NHL-DOR-91 US, having inventor Hubert ELMER, claiming priority from German Patent Application NO. 199 43 565.0, having inventor Hubert ELMER, filed on Sep. 13, 1999 and entitled, "Klemmbeschlag fur die eckverbinding von drei an einander grenzenden wanden"; U.S. patent application Ser. No. 09/835,865, having attorney docket No. NHL-DOR-92 US, having inventors Ralf KREYENBORG, Dirk SCHULTE, and Ernst Udo BLÖBAUM, claiming priority from German Patent Application No. 199 38 571,8, having inventors Ralf KREYENBORG, Dirk SCHULTE, and Ernst Udo BL ÖBAUM, filed on Aug. 17, 1999 and entitled, "Klemmbeschlag fur die befestigung von glasschieben"; U.S. patent application Ser. No. 09/838,349, having attorney docket No. NHL-DOR-93 US, having inventor Lothar GINZEL, claiming priority from German Patent Application No. 199 39 172.6, having inventor Lothar GINZEL, filed on Aug. 20, 1999 and entitled, "Punktformige halterung fur isolierglasschieben"; and U.S. Patent Application No. 09/868,031, having attorney docket No. NHL-DOR-96 US, having inventor Hubert ELMER, claiming priority from German Patent Application No. 199 45 196.6, having inventor Hubert ELMER, filed on Sep. 21, 1999 and entitled, "Befestigungsvorrichtung fur eine glasscheibe".

The following foreign patents and patent applications are hereby incorporated by reference as if set forth in their entirety herein: German Patent No. 197 40 878, having inventor Herbert KORDES, issued on Sep. 17, 1997 and entitled, "Klemmbeschlag fur die befestigung von glasscheiben"; German Patent No. 197 13 038.0, having inventor Ernst Udo BLÖBAUM, issued on Mar. 27, 1997 and entitled, "Klemmbeschlag fur die befestigung von glasscheiben"; German Patent No. 199 15 478.3, having inventors Ernst Udo BLÖBAUM and Reinhard JANUTTA, issued on Apr. 7, 1999 and entitled, "Beschlag zur halterung von sicherheitsglasschieben"; German Patent No. 199 15 193.8, having inventor Hubert ELMER, issued on Apr. 6, 1999 and entitled, "Befestigungsvorrichtung fur eine glasplatte an eine gebaudesteitegen halterung"; German Patent Application No. 199 43 565.0, having inventor Hubert ELMER, filed on Sep. 13, 1999 and entitled, "Klemmbeschlag fur die eckverbinding von drei an einander grenzenden wanden"; German Patent Application No. 199 38 571,8, having inventors Ralf KREYENBORG, Dirk SCHULTE, and Ernst Udo BLÖBAUM, filed on Aug. 17, 1999 and entitled, "Klemmbeschlag fur die befestigung von glasschieben"; German Patent Application No. 199 39 172.6, having inventor Lothar GINZEL, filed on Aug. 20, 1999 and entitled, "Punktformige halterung fur isolierglasschieben"; and German Patent Application No. 199 45 196.6, having inventor Hubert ELMER, filed on Sep. 21, 1999 and entitled, "Befestigungsvorrichtung fur eine glasscheibe".

All of the patents, patent applications or patent publications, which were cited in the PCT Search Report dated Nov. 17, 2000, and/or cited elsewhere are hereby incorporated by reference as if set forth in their entirety herein as follows: WO 96 24732 A, issued to HOFFMAN MANFRED, on Aug. 15, 1996.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

Some examples of glass mountings and glass mounting devices, features of which may possibly be utilized or adapted for use in at least one embodiment of the present invention may be found in the following U.S. Pat. No. 5,373,672, issued to Schulz on Dec. 20, 1994; U.S. Pat. No. 5,323,577, issued to Whitmyer on Jun. 28, 1994; U.S. Pat. No. 5,283,978, issued to Horgan, Jr. on Feb. 8, 1994; U.S. Pat. No. 5,212,922, issued to Werner on May 25, 1993; U.S. Pat. No. 4,841,679, issued to Hogg et al. on Jun. 27, 1989; U.S. Pat. No. 4,097,320, issued to Brauer et al. on Jun. 27, 1978; U.S. Pat. No. 4,054,268, issued to Sher on Oct. 18, 1977 and U.S. Pat. No. 4,016,690, issued to Richardson on Apr. 12, 1977. The aforementioned patents are hereby incorporated by reference as if set forth in their entirety herein.

Some examples of glass facades and methods of securing glass panels to a facade, features of which may possibly be utilized or adapted for use in at least one embodiment of the present invention may be found in the following U.S. Pat. No. 5,791,105, issued to Gangi on Aug. 11, 1998; U.S. Pat. No. 5,524,404, issued to Lahaye on Jun. 11, 1996; U.S. Pat. No. 5,301,484, issued to Jansson, on Apr. 12, 1996; U.S. Pat. No. 5,493,831, issued to Jansson on Feb. 27, 1996; U.S. Pat. No. 5,373,672, issued to Schulz on Dec. 20, 1994; U.S. Pat. No. 5,184,440, issued to Felix et al. on Feb. 9, 1993; U.S. Pat. No. 5,069,014, issued to Kubbutat on Dec. 3, 1991; U.S. Pat. No. 4,837,996, issued to Eckelt on Jun. 13, 1989; and U.S. Pat. No. 4,793,112, issued to Sufke on Dec. 27, 1988. The aforementioned patents are hereby incorporated by reference as if set forth in their entirety herein.

Some examples of other clamping fittings or connectors, features of which may possibly be utilized or adapted for use in at least one embodiment of the present invention may be found in the following U.S. Pat. No. 4,115,966, issued to DeLee on Sep. 26, 1978; U.S. Pat. No. 4,409,906, issued to Alneng on Oct. 18, 1983; U.S. Pat. No. 4,731,973, issued to Stenemann on Mar. 22, 1988; and U.S. Pat. No. 6,173,545 B1, issued to Feldpausch et al. on Jan. 16, 2001. The aforementioned patents are hereby incorporated by reference as if set forth in their entirety herein.

Some examples of rotating couplings or couplings with split rings, features of which may possibly be utilized or adapted for use in at least one embodiment of the present invention may be found in the following U.S. Pat. No. 4,448,448, issued to Pollia on May 15, 1984; U.S. Pat. No. 4,850,985, issued to Edwards et al. on Jul. 25, 1989; U.S. Pat. No. 4,954,004, issued to Faber et al. on Sep. 4, 1990; U.S. Pat. No. 5,201,554, issued to Gagg et al. on Apr. 13, 1993; U.S. Pat. No. 5,647,861, issued to Steer et al. on Jul. 15, 1997; U.S. Pat. No. 5,662,628, issued to Hollands on Sep. 2, 1997; U.S. Pat. No. 5,662,629, issued to Steer et al. on Sep. 2, 1997; and U.S. Pat. No. 5,830,200, issued to Steer et al. on Nov. 3, 1998. The aforementioned patents are hereby incorporated by reference as if set forth in their entirety herein.

The invention as described herein above in the context of the preferred embodiments is not to be taken as limited to all of the provided details thereof, since modifications and variations thereof may be made without departing from the spirit and scope of the invention.

NOMENCLATURE

1 Fastening device
2 Glass panel
3 Wall
4 Clamp fitting
5 Holder
6 Connecting bridge
7 Retaining pivot
8 Arms of the connecting bridge
9 Free ends of the connecting bridge
10 Connecting articulations that can be fixed in position
11 Compensating shaft
11' Compensating shaft
12 Ends of the compensating shaft
13 Articulation that can be fixed in position
14 Adapter
15 Pivot forks
16 Free end of the compensating shaft
17 Pivot brackets
18 Borings
19 Clamp screws
20 Cap bell
21 Cap nut
22 Shell surface
23 Shell surface
24 Flat
25 Flat
26 Shell surface
27 Flat
28 Allen screw
29 Pivot forks
30 Retaining flange
31 Support flange
32 Slot-like groove
33 Slot
34 Play
36 Cylindrical extension of cap bell
37 Elastic cushion
38 Screw or bolt
39 Clamp bolt
40 Split O-ring
41 Groove/Indentation
42 Slot/Indentation

100 First element of rotational part
43 Diameter of first element of rotational part
200 Second element of rotational part
44 Diameter of second element of rotational part
B Building
F Facade

What is claimed is:

1. On a facade of a structure, such as a building, a fastening device for attaching a glass panel to a structure, said fastening device comprising:

a first adapter being configured to be attached to and being attached to a structure;

a second adapter being configured to be attached to and being attached to a structure;

a fitting being configured to be attached to and being attached to a glass panel;

a first holder being configured to connect and connecting said fitting to said first adapter;

a second holder being configured to connect and connecting said fitting to said second adapter;

said first adapter having a first end and a second end;

said second adapter having a first end and a second end;

said first holder having a first end and a second end;

said second holder having a first end and a second end;

said fitting having a first end and a second end;

said first end of said first adapter being configured to be attached to and being attached to a structure;

said first end of said second adapter being configured to be attached to and being attached to a structure;

said first end of said first holder being configured to be attached to and being attached to said second end of said first adapter, said connection forming a first articulation to permit said first holder and said first adapter to be moved with respect to one another;

said first end of said second holder being configured to be attached to and being attached to said second end of said second adapter, said connection forming a second articulation to permit said second holder and said second adapter to be moved with respect to one another;

said second end of said first holder being configured to be attached to and being attached to said first end of said fitting, said connection forming a third articulation to permit said first holder and said fitting to be moved with respect to one another;

said second end of said second holder being configured to be attached to and being attached to said first end of said fitting, said connection forming a fourth articulation to permit said second holder and said fitting to be moved with respect to one another;

said second end of said fitting being configured to be attached to and being attached to a glass panel;

at least one of said first, said second, said third, and said fourth articulations being configured to permit back and forth swinging movement and rotational movement between said first and said second holder and at least one of said first adapter, said second adapter, and said fitting in three dimensions;

at least one of said first, said second, said third, and said fourth articulations comprising a rotational part;

at least one of said first, said second, said third, and said fourth articulations being configured to be fixed with respect to the corresponding end of said first or said second holder and thus fixing the corresponding one of said first adapter, said second adapter, and said fitting to said first or said second holder; and at least one of said first, said second, said third, and said fourth articulations being configured to compensate for construction tolerances and stress in a glass panel upon attachment of a glass panel to a structure.

2. The fastening device according to claim 1, wherein:

said fastening device further comprises a connecting bridge being configured to connect and connecting said first holder and said second holder and configured to connect said first and said second holder to said fitting;

said connecting bridge comprises a first arm and a second arm;

said first arm of said connecting bridge is configured to be attached to and attached to said second end of said first holder to form said third articulation;

said second arm of said connecting bridge is configured to be attached to and attached to said second end of said second holder to form said fourth articulation;

said connecting bridge is configured to be attached to and attached to said first end of said fitting;

said connecting bridge is configured to dispose said second end of said first holder and said second end of said second holder at an angle of ninety degrees from one another;

at least one part of at least one of said first, said second, said third, and said fourth articulations comprises a fork;

at least one part of at least one of said first, said second, said third, and said fourth articulations comprises a tongue;

said tongue is configured to be disposed in and disposed in said fork to provide back and forth swinging movement; and each of said first, said second, said third, and said fourth articulations has a hole being configured to receive a screw, said screw being configured to tighten its corresponding first, second, third, and fourth articulation.

3. The fastening device according to claim 2, including one of the following configurations: (A), (B), (C), and (D),wherein:

(A) one of said first, said second, said third, and said fourth articulations comprises a rotational part being configured to permit movement with a corresponding articulation of at least one of said first adapter, said second adapter, said first end of said first holder, said first end of said second holder, said second end of said. first holder, said second end of said second holder, and said first end of said fitting in three dimensions;

(B) two of said first, said second, said third, and said fourth articulations comprises a rotational part being configured to permit movement with a corresponding articulation of at least one of said first adapter, said second adapter, said first end of said first holder, said first end of said second holder, said second end of said first holder, said second end of said second holder, and said first end of said fitting in three dimensions;

(C) three of said first, said second, said third, and said fourth articulations comprise a rotational part being configured to permit movement with a corresponding articulation of at least one of said first adapter, said second adapter, said first end of said first holder, said first end of said second holder, said second end of said first holder, said second end of said second holder, and said first end of said fitting; and (D) all of said first, said second, said third, and said fourth articulations comprise a rotational part being configured to permit movement with a corresponding articulation of at said first adapter, said second adapter, said first end of said first holder, said first end of said second holder, said second end of said first holder, said second end of said second holder, and said first end of said fitting in three dimensions.

4. The fastening device according to claim 3, wherein:

said fitting further comprises:

a coupling bell being configured to connect and connecting said first end and said second end of said fitting; and a nut member being configured to fix said first end of said fitting with respect to said coupling bell of said fitting and being configured to be attached to and being attached to said coupling bell;

said nut member comprises an outer surface having a flattened portion being configured to receive a wrench to permit rotational adjustment of said nut member;

at least one of said first holder and said second holder comprises an outer surface having a flattened portion being configured to receive a wrench to permit rotational adjustment of said holder;

said first end of said fitting comprises an outer surface having a flattened portion being configured to receive a wrench to permit rotational adjustment of said first end of said fitting;

said fastening device further comprises a connecting element comprising said connecting bridge and said first end of said fitting; and said connecting element is configured to connect said first holder and said second holder and configured to attach said first and said second holder to said fitting.

5. A fastening device for attaching a glass panel to a structure, said fastening device comprising:

a first adapter being configured to be attached to a structure;

a second adapter being configured to be attached to a structure;

a fitting being configured to be attached to a glass panel;

a first holder being configured to connect said fitting to said first adapter;

a second holder being configured to connect said fitting to said second adapter;

said first adapter having a first end and a second end;

said second adapter having a first end and a second end;

said first holder having a first end and a second end;

said second holder having a first end and a second end;

said fitting having a first end and a second end;

said first end of said first adapter being configured to be attached to a structure;

said first end of said second adapter being configured to be attached to a structure;

said first end of said first holder being configured to be attached to said second end of said first adapter, said connection forming a first articulation to permit said first holder and said first adapter to be moved with respect to one another;

said first end of said second holder being configured to be attached to said second end of said second adapter, said connection forming a second articulation to permit said second holder and said second adapter to be moved with respect to one another;

said second end of said first holder being configured to be attached to said first end of said fitting, said connection forming a third articulation to permit said first holder and said fitting to be moved with respect to one another;

said second end of said second holder being configured to be attached to said first end of said fitting, said connection forming a fourth articulation to permit said second holder and said fitting to be moved with respect to one another;

said second end of said fitting being configured to be attached to a glass panel;

at least one of said first, said second, said third, and said fourth articulations being configured to permit back and forth swinging movement between said first and said second holder and at least one of said first adapter, said second adapter, and said fitting in at least two dimensions; and at least one of said first, said second, said third, and said fourth articulations being configured to be fixed with respect to the corresponding end of said first or said second holder and thus fixing the corresponding one of said first adapter, said second adapter, and said fitting to said first or said second holder.

6. The fastening device according to claim 5, wherein:

said fastening device further comprises a connecting bridge being configured to connect said first holder and said second holder and configured to connect said first and said second holder to said fitting;

said connecting bridge comprises a first arm and a second arm;

said first arm of said connecting bridge is configured to be attached to said second end of said first holder to form said third articulation;

said second arm of said connecting bridge is configured to be attached to said second end of said second holder to form said fourth articulation;

said connecting bridge is configured to be attached to said first end of said fitting; and said connecting bridge is configured to dispose said second end of said first holder and said second end of said second holder at an angle of ninety degrees from one another.

7. The fastening device according to claim 6, wherein:

at least one part of at least one of said first, said second, said third, and said fourth articulations comprises a fork;

at least one part of at least one of said first, said second, said third, and said fourth articulations comprises a tongue;

said tongue is configured to be disposed in said fork to provide back and forth swinging movement; and each of said first, said second, said third, and said fourth articulations has a hole being configured to receive a screw, said screw being configured to tighten its corresponding first, second, third, and fourth articulation.

8. The fastening device according to claim 7, wherein at least one of said first adapter, said second adapter, said first end of said first holder, said first end of said second holder, said second end of said first holder, said second end of said second holder, and said first end of said fitting comprises a rotational part being configured to permit movement with a corresponding articulation of at least one of said first adapter, said second adapter, said first end of said first holder, said first end of said second holder, said second end of said first holder, said second end of said second holder, and said first end of said fitting in three dimensions.

9. The fastening device according to claim 8, wherein at least two of said first adapter, said second adapter, said first end of said first holder, said first end of said second holder, said second end of said first holder, said second end of said second holder, and said first end of said fitting comprise a rotational part being configured to permit movement with a corresponding articulation of at least two of said first adapter, said second adapter, said first end of said first holder, said first end of said second holder, said second end of said first holder, said second end of said second holder, and said first end of said fitting in three dimensions.

10. The fastening device according to claim 9, wherein all of said first adapter, said second adapter, said first end of said first holder, said first end of said second holder, said second end of said first holder, said second end of said second holder, and said first end of said fitting comprises a rotational part being configured to permit movement with a corresponding articulation of said first adapter, said second adapter, said first end of said first holder, said first end of said second holder, said second end of said first holder, said second end of said second holder, and said first end of said fitting in three dimensions.

11. The fastening device according to claim 10, wherein:

said fitting further comprises:

a coupling bell being configured to connect said first end and said second end of said fitting; and a nut member being configured to fix said first end of said fitting with respect to said coupling bell of said fitting and being configured to be attached to said coupling bell;

said nut member comprises an outer surface having a flattened portion being configured to receive a wrench to permit rotational adjustment of said nut member;

at least one of said first holder and said second holder comprises an outer surface having a flattened portion being configured to receive a wrench to permit rotational adjustment of said holder; and said first end of said fitting comprises an outer surface having a flattened portion being configured to receive a wrench to permit rotational adjustment of said first end of said fitting.

12. The fastening device according to claim 11, wherein:

said fastening device further comprises a connecting element comprising said connecting bridge and said first end of said fitting; and said connecting element is configured to connect said first holder and said second holder and configured to attach said first and said second holder to said fitting.

13. A method of fastening a facade on a structure, such as a building, with a fastening device for attaching a glass panel to a structure, said fastening device comprising: a first adapter being configured to be attached to a structure; a second adapter being configured to be attached to a structure; a fitting being configured to be attached to a glass panel; a first holder being configured to connect said fitting to said first adapter; a second holder being configured to connect said fitting to said second adapter; said first adapter having a first end and a second end; said second adapter having a first end and a second end; said first holder having a first end and a second end; said second holder having a first end and a second end; said fitting having a first end and a second end; said first end of said first adapter being configured to be attached to a structure; said first end of said second adapter being configured to be attached to a structure; said first end of said first holder being configured to be attached to said second end of said first adapter, said connection forming a first articulation to permit said first holder and said first adapter to be moved with respect to one another; said first end of said second holder being configured to be attached to said second end of said second adapter, said connection forming a second articulation to permit said second holder and said second adapter to be moved with respect to one another; said second end of said first holder being configured to be attached to said first end of said fitting, said connection forming a third articulation to permit said first holder and said fitting to be moved with respect to one another; said second end of said second holder being configured to be attached to said first end of said fitting, said connection forming a fourth articulation to permit said second holder and said fitting to be moved with respect to one another; said second end of said fitting being configured to be attached to a glass panel; at least one of said first, said second, said third, and said fourth articulations being configured to permit back and forth swinging movement between said first and said second holder and at least one of said first adapter, said second adapter, and said fitting in at least two dimensions; and at least one of said first, said second, said third, and said fourth articulations being configured to be fixed with respect to the corresponding end of said first or said second holder and thus fixing the corresponding one of said first adapter, said second adapter, and said fitting to said first or said second holder;

said method comprising the steps of:

attaching said second end of said first adapter to said first end of said first holder to form said first articulation;

attaching said second end of said second adapter to said first end of said second holder to form said second articulation;

attaching said second end of said first holder to said first end of said fitting to form said third articulation;

attaching said second end of said second holder to said first end of said fitting to form said fourth articulation;

attaching said first end of said first adapter to a structure;

attaching said first end of said second adapter to a structure;

adjusting said first, said second, said third, and said fourth articulations to compensate for tolerances;

fastening said second end of said fitting to a glass panel; and tightening said first, said second, said third, and said fourth articulations to secure connection of said fastening device to a glass panel and a structure.

14. The method of fastening a facade on a structure according to claim 13, wherein said fastening device further comprises said fastening device further comprises a connecting bridge being configured to connect said first holder and said second holder and configured to connect said first and said second holder to said fitting; said connecting bridge comprises a first arm and a second arm; said first arm of said connecting bridge is configured to be attached to said second end of said first holder to form said third articulation; said second arm of said connecting bridge is configured to be attached to said second end of said second holder to form said fourth articulation; said connecting bridge is configured to be attached to said first end of said fitting; and said connecting bridge is configured to dispose said second end of said first holder and said second end of said second holder at an angle of ninety degrees from one another;

said method further comprises the steps of:

attaching said second end of said first holder to said first arm of said connecting bridge;

attaching said second end of said second holder to said second arm of said connecting bridge;

attaching said connecting bridge to said first end of said fitting; and positioning said second end of said first holder and said second end of said second holder at an angle from one another.

15. The method of fastening a facade on a structure according to claim 14, wherein at least one part of at least one of said first, said second, said third, and said fourth articulations comprises a fork; at least one part of at least one of said first, said second, said third, and said fourth articulations comprises a tongue; said tongue is configured to be disposed in said fork to provide back and forth movement; and each of said first, said second, said third, and said fourth articulations has a hole being configured to receive a screw, said screw being configured to tighten its corresponding first, second, third, and fourth articulation;

said method further comprises the steps of:

inserting said tongue into said fork to form at least one of said first, said second, said third, and said fourth articulations and to provide back and forth swinging movement;

inserting a screw into its corresponding hole in each of said first, said second, said third, and said fourth articulations; and tightening said screws to fix said first, said second, said third, and said fourth articulations into position.

16. The method of fastening a facade on a structure according to claim 15, wherein at least one of said first adapter, said second adapter, said first end of said first holder, said first end of said second holder, said second end of said first holder, said second end of said second holder, and said first end of said fitting comprises a rotational part being configured to permit movement with a corresponding articulation of at least one of said first adapter, said second adapter, said first end of said first holder, said first end of said second holder, said second end of said first holder, said second end of said second holder, and said first end of said fitting in three dimensions;

said method further comprises the step of:

rotating said at least one rotational part.

17. The method of fastening a facade on a structure according to claim 16, wherein at least two of said first adapter, said second adapter, said first end of said first holder, said first end of said second holder, said second end of said first holder, said second end of said second holder, and said first end of said fitting comprise a rotational part being configured to permit movement with a corresponding articulation of at least two of said first adapter, said second adapter, said first end of said first holder, said first end of said second holder, said second end of said first holder, said second end of said second holder, and said first end of said fitting in three dimensions;

said method further comprises the step of:

rotating said at least two rotational parts.

18. The method of fastening a facade on a structure according to claim 17, wherein all of said first adapter, said second adapter, said first end of said first holder, said first end of said second holder, said second end of said first holder, said second end of said second holder, and said first end of said fitting comprises a rotational part being configured to permit movement with a corresponding articulation of said first adapter, said second adapter, said first end of said first holder, said first end of said second holder, said second end of said first holder, said second end of said second holder, and said first end of said fitting in three dimensions;

said method further comprises the step of:

rotating said rotational parts.

19. The method of fastening a facade on a structure according to claim 18, wherein said fitting further comprises a coupling bell being configured to connect said first end and said second end of said fitting; a nut member being configured to fix said first end of said fitting with respect to said coupling bell of said fitting and being configured to be attached to said coupling bell; said nut member comprises an outer surface having a flattened portion being configured to receive a wrench to permit rotational adjustment of said nut member; at least one of said first holder and said second holder comprises an outer surface having a flattened portion being configured to receive a wrench to permit rotational adjustment of said holder; and said first end of said fitting comprises an outer surface having a flattened portion being configured to receive a wrench to permit rotational adjustment of said first end of said fitting;

said method further comprises the steps of:

attaching said coupling bell to said first end and to said second end of said fitting;

attaching said nut member to said coupling bell of said fitting;

adjusting said nut member to tighten the connection between said first end of said fitting and said coupling bell of said fitting;

adjusting at least one of said first and said second holders to tighten the connection between said holder and a corresponding at least one of said first adapter, said second adapter, and said connecting bridge; and adjusting said first end of said fitting to tighten the connection between said fitting and said connecting bridge.

20. The method of fastening a facade on a structure according to claim 19, wherein said fastening device further comprises a connecting element comprising said connecting bridge and said first end of said fitting; and said connecting element is configured to connect said first holder and said second holder and configured to attach said first and said second holder to said fitting;

said method further comprises the step of:

attaching said connecting element to said first holder and to said second holder; and attaching said connecting element to said fitting.

* * * * *

UNITED STATES PATENT AND TRADEMARK OFFICE

CERTIFICATE OF CORRECTION

PATENT NO. : 6,467,227 B2
DATED : October 22, 2002
INVENTOR(S) : Hubert Elmer

It is certified that error appears in the above-identified patent and that said Letters Patent is hereby corrected as shown below:

Column 10,
Line 21, after "that", delete "gripes" and insert -- grips --.

Column 18,
Line 49, after the third occurrence of "said" delete -- . --.

Signed and Sealed this

Eighteenth Day of March, 2003

JAMES E. ROGAN
*Director of the United States Patent and Trademark Office*